US011056771B2

(12) United States Patent
Jia

(10) Patent No.: US 11,056,771 B2
(45) Date of Patent: Jul. 6, 2021

(54) ANTENNA MODULE AND ELECTRONIC DEVICE

(71) Applicant: GUANGDONG OPPO MOBILE TELECOMMUNICATIONS CORP., LTD., Guangdong (CN)

(72) Inventor: Yuhu Jia, Guangdong (CN)

(73) Assignee: GUANGDONG OPPO MOBILE TELECOMMUNICATIONS CORP., LTD., Dongguan (CN)

( * ) Notice: Subject to any disclaimer, the term of this patent is extended or adjusted under 35 U.S.C. 154(b) by 0 days.

(21) Appl. No.: 16/816,875

(22) Filed: Mar. 12, 2020

(65) Prior Publication Data

US 2020/0313282 A1 Oct. 1, 2020

(30) Foreign Application Priority Data

Mar. 28, 2019 (CN) ..... 201910244229.2

(51) Int. Cl.
*H01Q 9/04* (2006.01)
*H01Q 5/30* (2015.01)
(Continued)

(52) U.S. Cl.
CPC ..... *H01Q 1/243* (2013.01); *H01Q 1/48* (2013.01); *H01Q 5/307* (2015.01);
(Continued)

(58) Field of Classification Search
CPC .. H01Q 1/42; H01Q 5/00; H01Q 9/04; H01Q 9/0407; H01Q 9/045
See application file for complete search history.

(56) References Cited

U.S. PATENT DOCUMENTS 8,269,671 B2 9/2012 Chen et al.
2007/0126638 A1* 6/2007 Channabasappa ... H01Q 9/0442 343/700 MS
(Continued)

FOREIGN PATENT DOCUMENTS

CA 3017262 A1 * 11/2017 ..... H01Q 9/0414
CN 101141023 A 3/2008
(Continued)

OTHER PUBLICATIONS

A Dual-Frequency Broad-Band Design of Coupled-Fed Stacked Microstrip Monopolar Patch Antenna for WLAN Applications.
(Continued)

*Primary Examiner* — Blane J Jackson

(57) ABSTRACT

The present disclosure relates to an antenna module and an electronic device. The antenna module includes: a first dielectric layer; a ground layer arranged on the first dielectric layer, and provided with at least one slot; a second dielectric layer arranged on the ground layer, and provided with an air chamber communicated with the at least one slot; a stacked patch antenna including a first radiation patch and a second radiation patch, the first radiation patch being attached to a side of the second dielectric layer facing away from the ground layer, and the second radiation patch being attached to a side of the second dielectric layer provided with the air chamber; and a feeding unit arranged to a side of the first dielectric layer facing away from the ground layer, and configured to feed the stacked patch antenna by the at least one slot.

20 Claims, 12 Drawing Sheets

(51) Int. Cl.

| | |
|---|---|
| ***H01Q 1/24*** | (2006.01) |
| ***H01Q 5/307*** | (2015.01) |
| ***H01Q 1/48*** | (2006.01) |
| ***H01Q 13/10*** | (2006.01) |

(52) U.S. Cl.
CPC ..... *H01Q 9/0414* (2013.01); *H01Q 9/0464* (2013.01); *H01Q 13/10* (2013.01)

(56) References Cited

U.S. PATENT DOCUMENTS

| | | | | |
|---|---|---|---|---|
| 2009/0207080 | A1* | 8/2009 | Floyd | H01L 23/66 343/700 MS |
| 2010/0052994 | A1* | 3/2010 | Llorens del Rio | H01Q 21/0087 343/700 MS |
| 2010/0134378 | A1* | 6/2010 | Duchesne | H01Q 9/0457 343/872 |
| 2013/0044035 | A1 | 2/2013 | Zhuang | |
| 2018/0159203 | A1* | 6/2018 | Baks | H01Q 9/0407 |

FOREIGN PATENT DOCUMENTS

| | | | |
|---|---|---|---|
| CN | 101931122 | A | 12/2010 |
| CN | 102332635 | A | 1/2012 |
| CN | 104701610 | A | 6/2015 |
| CN | 107591608 | A | 1/2018 |
| CN | 207398350 | U | 5/2018 |
| CN | 207690994 | U | 8/2018 |
| CN | 109149068 | A | 1/2019 |
| CN | 110048224 | A | 7/2019 |
| DE | 102005048274 | A1 | 4/2007 |
| EM | 3401998 | A1 | 11/2018 |
| EP | 1793451 | A1 | 6/2007 |
| KR | 101669607 | B1 | 10/2016 |

OTHER PUBLICATIONS

A Dual-frequency stacked annular-ring microstrip antenna.
European Search Report dated Aug. 24, 2020 from Application No. 20165950.5-1205.
International Search Report dated Jun. 22, 2020 from International Application No. PCT/CN2020/080015.
China First Office Action with English Translation for CN Application 201910244229.2 dated Mar. 31, 2021. (23 pages).
India Examinatiom Report for IN Application 202014011967 dated Apr. 30, 2021, (5 pages).

* cited by examiner

ANTENNA MODULE AND ELECTRONIC DEVICE

CROSS-REFERENCE TO RELATED APPLICATION(S)

This application claims priority to and benefit of Chinese Patent Application Serial No. 201910244229.2, filed on Mar. 28, 2019, the entire content of which is incorporated by reference.

TECHNICAL FIELD

The present disclosure relates to a field of antenna technology, and more particularly to an antenna module and an electronic device.

BACKGROUND

With the development of wireless communication technology, 5G network technology is born. As the fifth generation of mobile communication network, a peak theoretical transmission speed of 5G network may be up to tens of Gb per second, which is hundreds times as fast as that of 4G network. Therefore, a millimeter wave band with enough spectrum resources has become one of working frequency bands of a 5G communication system.

In general, a millimeter wave antenna module for radiating millimeter wave signals may be arranged in a housing of an electronic device (such as a mobile phone) to support reception and transmission of millimeter wave signals. Generally, an antenna bandwidth of the millimeter wave antenna module may only meet requirements of partial 3GPP frequency bands (such as n257, or, n261 and n260), but cannot meet requirements of full 3GPP frequency bands (such as n257, n258, n260 and n261).

SUMMARY

Embodiments of the present disclosure provide an antenna module and an electronic device.

The antenna module according to a first aspect of embodiments of the present disclosure includes: a first dielectric layer; a ground layer arranged on the first dielectric layer, and provided with at least one slot; a second dielectric layer arranged on the ground layer, and provided with an air chamber communicated with the at least one slot; a stacked patch antenna including a first radiation patch and a second radiation patch, the first radiation patch being attached to a side of the second dielectric layer facing away from the ground layer, the second radiation patch being attached to a side of the second dielectric layer provided with the air chamber, an orthogonal projection of the first radiation patch on the ground layer covering at least part of the at least one slot, and an orthogonal projection of the second radiation patch on the ground layer covering at least part of the at least one slot; and a feeding unit arranged to a side of the first dielectric layer facing away from the ground layer, and configured to feed the stacked patch antenna through the at least one slot. The first radiation patch is configured to generate a resonance in a first frequency band under the feeding of the feeding unit, and the second radiation patch is configured to generate a resonance in a second frequency band under the feeding of the feeding unit.

The antenna module according to a second aspect of embodiments of the present disclosure includes: a first dielectric layer; a ground layer arranged on the first dielectric layer, and defining a first slot and a second slot therein; a second dielectric layer arranged on the ground layer, and defining an air chamber in a side adjacent to the ground layer, the air chamber being communicated with the first slot and the second slot, respectively; a stacked patch antenna including a first radiation patch and a second radiation patch, the first radiation patch being attached to a side of the second dielectric layer facing away from the ground layer, the second radiation patch being received in the air chamber and attached to a bottom of the air chamber facing the ground layer, an orthogonal projection of the first radiation patch on the ground layer covering at least one of at least part of the first slot and at least part of the second slot, and an orthogonal projection of the second radiation patch on the ground layer covering at least one of at least part of the first slot and at least part of the second slot; and a feeding unit arranged to a side of the first dielectric layer facing away from the ground layer, and configured to feed the first radiation patch through the first slot and feed the second radiation patch through the second slot.

The electronic device according to a third aspect of embodiments of the present disclosure includes a housing, an antenna base plate, a stacked patch antenna, and a feeding unit. The antenna base plate is arranged to the housing, and includes: a first dielectric layer; a ground layer arranged on the first dielectric layer, and having at least one slot therein; and a second dielectric layer arranged on the ground layer, and defining an air chamber therein, the air chamber being communicated with the at least one slot. The stacked patch antenna includes a first radiation patch and a second radiation patch, the first radiation patch is attached to a side of the second dielectric layer facing away from the ground layer, and the second radiation patch is attached to a side of the second dielectric layer provided with the air chamber. An orthogonal projection of the first radiation patch on the ground layer covers at least part of the at least one slot, and an orthogonal projection of the second radiation patch on the ground layer covers at least part of the at least one slot. The feeding unit is arranged to a side of the first dielectric layer facing away from the ground layer, and configured to feed the stacked patch antenna through the at least one slot. The first radiation patch is configured to generate a resonance in a first frequency band under the feeding of the feeding unit, and the second radiation patch is configured to generate a resonance in a second frequency band under the feeding of the feeding unit.

BRIEF DESCRIPTION OF DRAWINGS

In order to more clearly explain technical solutions in embodiments of the present disclosure or in the related art, the drawings needed to be used in descriptions of the embodiments or the related art will be introduced briefly. Obviously, the drawings in the following descriptions are merely some embodiments of the present disclosure. For those ordinary skilled in the related art, other drawings may be obtained according to theses drawings without creative labors.

DETAILED DESCRIPTION

In order to make the purpose, technical solution and advantages of the present disclosure clearer, the present disclosure will be further described in detail below with reference to the accompanying drawings and embodiments. It should be understood that the embodiments described herein are merely used to explain the present disclosure, and cannot be construed as a limitation to the present disclosure.

It should be understood that, although terms such as "first" and "second" are used herein for describing various elements, these elements should not be limited by these terms. These terms are only used for distinguishing one element from another element, and are not intended to indicate or imply relative importance or significance or to imply the number of indicated technical features. Thus, the feature defined with "first" and "second" may explicitly or implicitly include one or more of this feature. In the description of the present disclosure, "a plurality of" means two or more than two, such as two and three, unless specified otherwise.

It should be noted that when an element is called to be arranged to another element, it may be directly arranged on another component or there may be an intermediate element. When an element is considered to be connected to another element, it may be directly connected to another component or there may be an intermediate element.

An antenna module according to an embodiment of the present disclosure is applied to an electronic device. In an embodiment, the electronic device may include a mobile phone, a tablet computer, a notebook computer, a palmtop computer, a mobile Internet device (MID), a wearable device (such as a smart watch, a smart bracelet, a pedometer, and so on) or other communication modules provided with an array antenna module.

Figure 1:
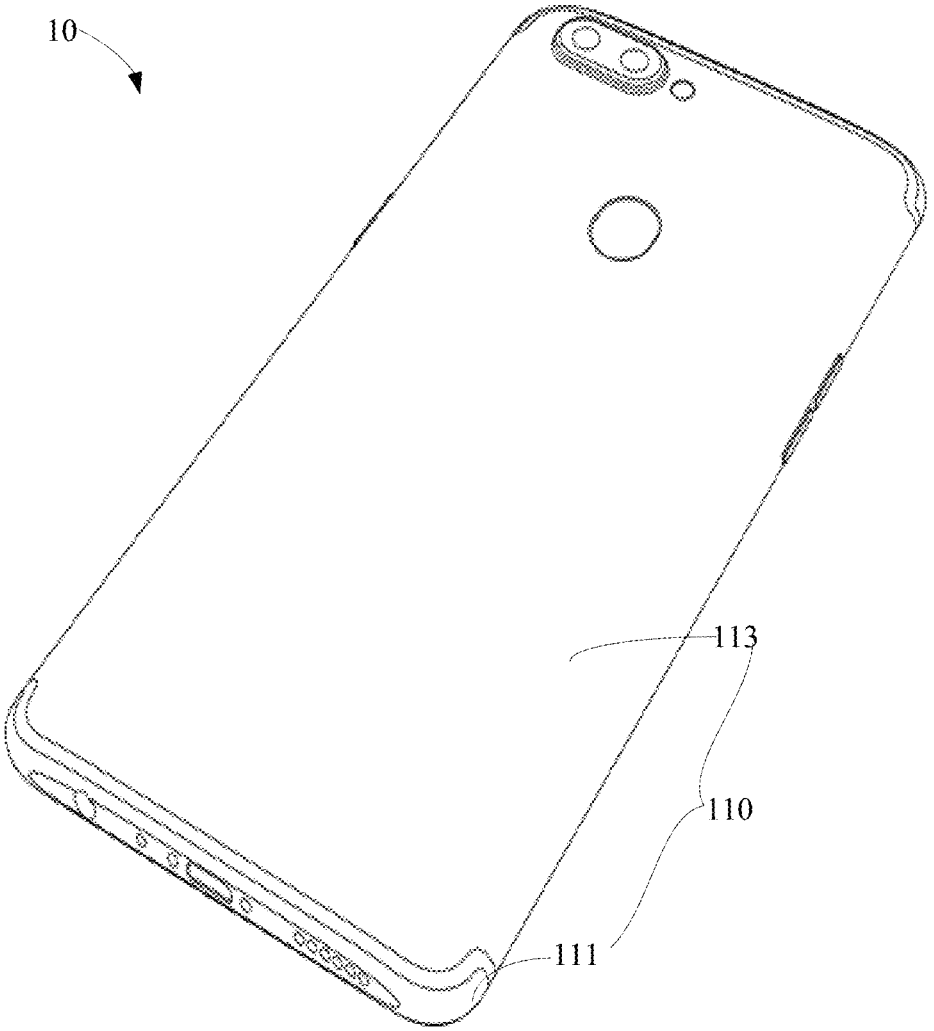
FIG. 1 is a perspective view of an electronic device in an embodiment.

As illustrated in FIG. 1, in the embodiment of the present disclosure, the electronic device 10 may include a housing assembly 110, a substrate, a display assembly, and a controller. The display assembly is fixed to the housing assembly 110 and forms an external structure of the electronic device together with the housing assembly 110. The housing assembly 110 may include a middle frame 111 and a rear cover 113. The middle frame 111 may be a frame structure having a through hole. The middle frame 111 may be accommodated in an accommodating space formed by the display assembly and the rear cover 113. The rear cover 113 is used to form an external profile of the electronic device. The rear cover 113 may be formed integrally. In a molding process of the rear cover 113, a rear camera hole, a fingerprint identification module, an antenna module mounting hole and other structures may be formed in the rear cover 113. The rear cover 113 may be a non-metallic rear cover 113. For example, the rear cover 113 may be a plastic rear cover 113, a ceramic rear cover 113, a 3D glass rear cover 113, and so on. The substrate is fixed inside the housing assembly, and may be a printed circuit board (PCB) or a flexible printed circuit board (FPCB). An antenna module for receiving and transmitting millimeter wave signals and a controller configured to control an operation of the electronic device may be integrated on the substrate. The display component may be used to display pictures or texts, and may provide a user with an operation interface.

Figure 2:
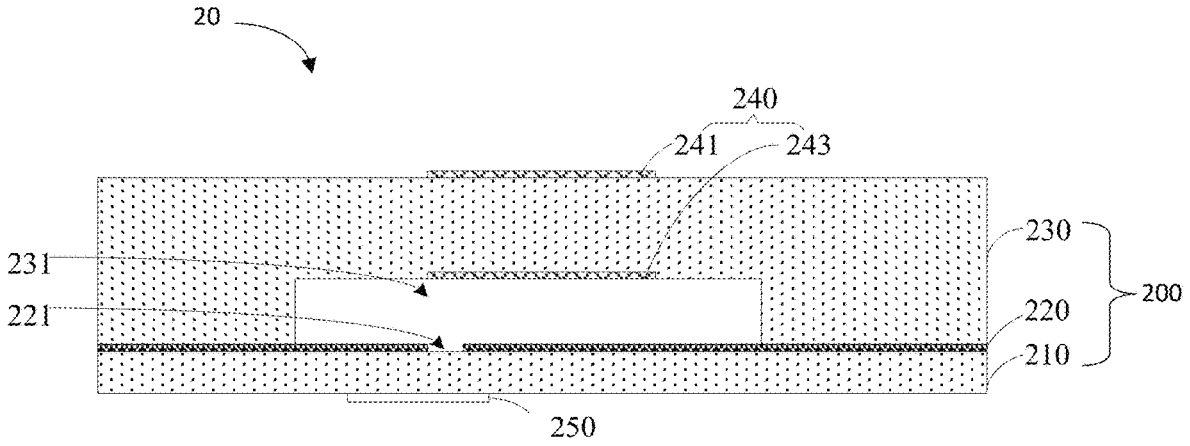
FIG. 2 is a sectional view of an antenna module in an embodiment.

As illustrated in FIG. 2, in an embodiment, the antenna module 20 includes a first dielectric layer 210, a ground layer 220, a second dielectric layer 230, a stacked patch antenna 240, and a feeding unit 250.

The materials of the first dielectric layer 210 and the second dielectric layer 230 are both low temperature co-fired ceramic (LTCC), which is a multilayer circuit made by stacking an unsintered casting ceramic materials together, provided with printed interconnection conductors, elements and circuits therein, and sintered into integrated ceramic multilayer materials. Dielectric constants of the first dielectric layer 210 and the second dielectric layer 230 are in a range from 5.8 to 8. In the process of forming the first dielectric layer 210 and the second dielectric layer 230, the first dielectric layer 210 and the second dielectric layer 230 with preset thicknesses may be stacked by the LTCC technology.

The ground layer 220 is arranged on the first dielectric layer 210, and the second dielectric layer 230 is arranged on the ground layer 220. That is, the ground layer 220 is arranged between the first dielectric layer 210 and the second dielectric layer 230, and the ground layer 220 is provided with at least one slot 221. That is, at least one slot 221 is introduced into the ground layer 220.

The second dielectric layer 230 is provided with an air chamber 231 which is communicated with each slot 221. In an embodiment, the air chamber 231 is formed according to the LTCC technology, that is, the air chamber 231 is introduced by using the LTCC technology.

The stacked patch antenna 240 includes a first radiation patch 241 and a second radiation patch 243 arranged corresponding to the at least one slot 221. In some embodiments, an orthogonal projection of the first radiation patch 241 on the ground layer 220 may cover at least part of the at least one slot 221, and an orthogonal projection of the second radiation patch 243 on the ground layer 220 may cover at least part of the at least one slot 221.

The first radiation patch 241 is attached to a side of the second dielectric layer 230 facing away from the ground layer 220, and the second radiation patch 243 is attached to a side of the second dielectric layer 230 provided with the air chamber 231. The second dielectric layer 230 includes an outer surface and an inner surface facing away from each other. The outer surface is a surface facing away from the ground layer 220, and the inner surface is a surface facing towards both the ground layer 220 and the air chamber 231. That is, the first radiation patch 241 is arranged corresponding to the second radiation patch 243, the first radiation patch 241 is attached to the outer surface of the second dielectric layer 230, and the second radiation patch is attached to the inner surface of the second dielectric layer 230. In an embodiment, at least a part of the first radiation patch 241 is orthogonally projected on an area where the second radiation patch 243 is located. That is, the first radiation patch 241 may be partially orthogonally projected on the area where the second radiation patch 243 is located, or may be completely projected on the area where the second radiation patch is located. The first radiation patch 241 and the second radiation patch 243 are orthogonally projected on an area of the ground layer 220, and at least partially overlap the at least one slot 221. That is, an orthogonal projection of the first radiation patch 241 on the area of the ground layer 220 may cover all or a part of an area of the slot 221, and an orthogonal projection of the second radiation patch 243 on the area of the ground layer 220 may cover all or a part of the area of the slot 221.

In an embodiment, both of the first radiation patch 241 and the second radiation patch 243 may be one of a square patch, a round patch, a loop patch and a cross patch. The shapes of the first radiation patch 241 and the second radiation patch 243 may be the same or different. For example, the first radiation patch 241 is the loop patch antenna, such as a square loop patch or a circular loop patch. The second radiation patch 243 is one of the square patch, the round patch, the loop patch and the cross patch. In this embodiment, when the first radiation patch 241 is the loop patch antenna, the effective radiation efficiency of the second radiation patch 243 can be increased.

It should be noted that a position relationship between the first radiation patch 241 and the second radiation patch 243, as well as the shapes of the first radiation patch 241 and the second radiation patch 243, may be set according to the number of slots 221, which is not further limited herein.

In an embodiment, the materials of the first radiation patch 241 and the second radiation patch 243 may be metal materials, transparent conductive materials with high conductivity (such as indium tin oxide, silver nanowire, ITO materials, graphene, and so on).

The feeding unit 250 is located to a side of the first dielectric layer 210 facing away from the ground layer 220. The feeding unit 250 feeds the stacked patch antenna 240 (the first radiation patch 241 and the first radiation patch 241) through the slot 221. In some embodiments, an orthogonal projection of the feeding unit 250 on the area of the ground layer 220 may completely cover the area where the slot 221 is located.

In an embodiment, the feeding unit 250 includes at least one feeding route. The number of feeding routes is equal to the number of the slots 221 provided in the ground layer 220. In some embodiments, the feeding route is a strip line, whose impedance is easy to control and whose shielding is good, thus effectively reducing a loss of electromagnetic energy and improving the efficiency of the antenna.

In an embodiment, a height of the air chamber 231 may be set to a preset height by comprehensively considering a thickness of the first radiation patch 241, a thickness of the second radiation patch 243, a machining process of the LTCC technology and other factors, so as to conduct an effective coupled feeding on the stacked patch antenna 240 through the slot 221 arranged in the ground layer 220. In an embodiment, the preset height is 0.2 mm-0.5 mm, so as to improve the coupling strength.

It should be noted that the height of the air chamber 231 refers to a height in a direction perpendicular to the first dielectric layer 210 or the second dielectric layer 230 or the stacked patch antenna 240.

Due to the arrangement of the air chamber 231, the coupling with the stacked patch antenna 240 can be achieved through the slot 221 so as to generate a resonance in a preset frequency band, such that the first radiation patch 241 generates a resonance in a first frequency band and the second radiation patch 243 generates a resonance in a second frequency band, so as to realize a full frequency coverage of the antenna module.

In an embodiment, sizes of various slots 221 arranged in the ground layer 220 are adjusted to be coupled with the stacked patch antenna 240 (the first radiation patch 241 and the second radiation patch 243) so as to generate a resonance in a third frequency band. For example, the size (such as a length and a width) of the slot 221 may be changed. When the length of the slot 221 is set to ½ of a dielectric wavelength, the coupling between the slot 221 and the stacked patch antenna 240 (the first radiation patch 241 and the second radiation patch 243) can generate a resonance in the vicinity of a frequency band of 25 GHz-26 GHz. Moreover, based on the air chamber 231, the slot 221 can conduct a coupled feeding with the first radiation patch 241 to allow the first radiation patch 241 to generate a resonance of 28 GHz, and can conduct a coupled feeding with the second radiation patch 243 to allow the second radiation patch 243 to generate a resonance of 39 GHz, so as to realize the full frequency coverage of the antenna module.

According to rules of 3GPP 38. 101 Agreement, 5G NR mainly uses two frequency bands: FR1 frequency band and FR2 frequency band. The frequency range of FR1 frequency band is 450 MHz-6 GHz, which is usually called sub 6 GHz. The frequency range of FR2 frequency band is 4.25 GHz-52.6 GHz, which is usually called millimeter wave (mm Wave). The 3GPP specifies frequency bands of the 5G millimeter wave as follows: n257 (26.5-29.5 GHz), n258 (24.25-27.5 GHz), n261 (27.5-28.35 GHz) and n260 (37-40 GHz).

The above antenna module adopts the LTCC technology to introduce the air chamber 231 in the second dielectric layer 230, and introduces the slot 221 communicated with the air chamber 231 in the ground layer 220. Due to the introduction of the air chamber 231, the stacked patch antenna 240 (the first radiation patch 241 and the second radiation patch 243) may be fed by means of coupling through the slot 221, such that the first radiation patch 241 generates the resonance in the first frequency band and the second radiation patch 243 generates the resonance in the second frequency band. Thus, the full frequency coverage of the antenna module is achieved. That is, the 3GPP full frequency requirement is realized. For example, the coverage of n257, n258 and n261 bands may be realized, and also, the radiation efficiency of the antenna may be improved.

In an embodiment, the first dielectric layer 210, the ground layer 220, the second dielectric layer 230, the stacked patch antenna 240 and the feeding unit 250 are integrated by adopting the LTCC technology, thus realizing the feeding of the multi-layer structure of the antenna module through the slot 221, avoiding a problem of a high inductance value and matching difficulties caused by the coupled feeding through the small hole, and also reducing a volume of the antenna module.

Figure 3A:
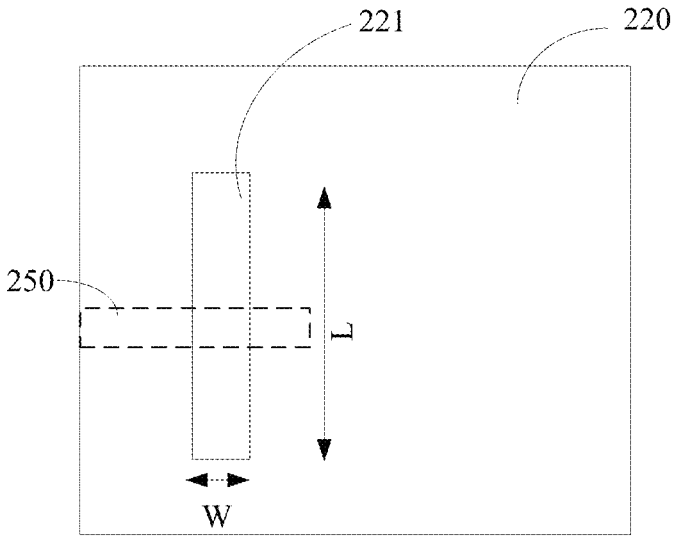
FIG. 3A is a schematic view of a single slot and a single feeding unit in an embodiment.

As illustrated in FIG. 3A, in an embodiment, the slot 221 is a rectangular slot, and a routing direction of the feeding unit 250 is arranged perpendicularly to a length direction of the rectangular slot. The length direction may be understood as a direction (L) arranged along a long edge of the rectangular slot, and a width direction may be understood as a direction (W) arranged along a short edge of the rectangular slot.

Figure 3B:
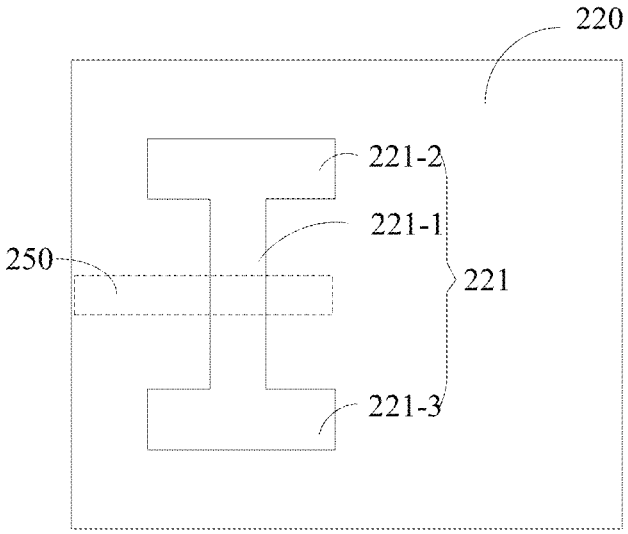
FIG. 3B is a schematic view of a single slot and a single feeding unit in another embodiment.

As illustrated in FIG. 3B, in an embodiment, the slot 221 includes a first part 221-1 as well as a second part 221-2 and a third part 221-3 which are communicated with the first part 221-1, respectively. The second part 221-2 and the third part 221-3 are arranged in parallel, and the first part 221-1 is arranged perpendicularly to the second part 221-2 and the third part 221-3, respectively. The first part 221-1, all the second part 221-2 and the third part 221-3 are linear slots 221, and the routing direction of the feeding unit 250 is arranged perpendicularly to the first part 221-1.

It should be noted that the feeding unit 250 includes a feeding route, which is a strip line, and the routing direction of the feeding unit 250 may be understood as an extending direction of the strip line.

In an embodiment, at least a part of the slot 221 is orthogonally projected on areas of the first radiation patch 241 and the second radiation patch 243. That is, the slot 221 may be partially or completely orthogonally projected on the area of the first radiation patch 241, and may also be partially or completely orthogonally projected on the area of the second radiation patch 243. Based on the air chamber 231, the first radiation patch 241 and the second radiation patch 243 both have the coupled feeding through the slot 221, such that the slot 221 and the first radiation patch 241 generate the 28 GHz resonance, and the slot 221 and the second radiation patch 243 generate the 39 GHz resonance, so as to realize the full frequency coverage of the antenna module.

Figure 4A:
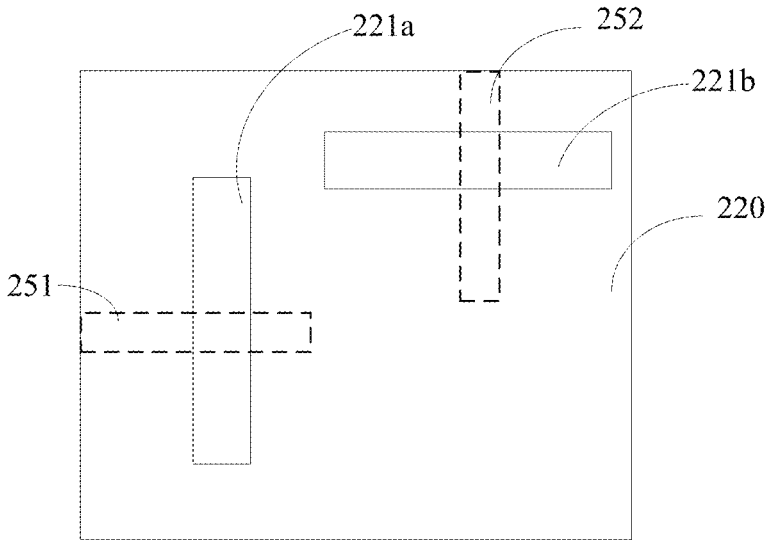
FIG. 4A is a schematic view of double slots and double feeding units in an embodiment.
Figure 4B:
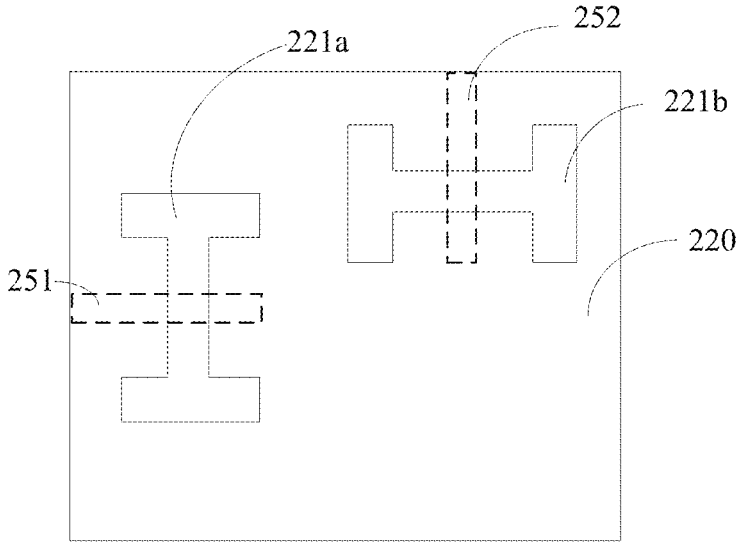
FIG. 4B is a schematic view of double slots and double feeding units in another embodiment.
Figure 5:
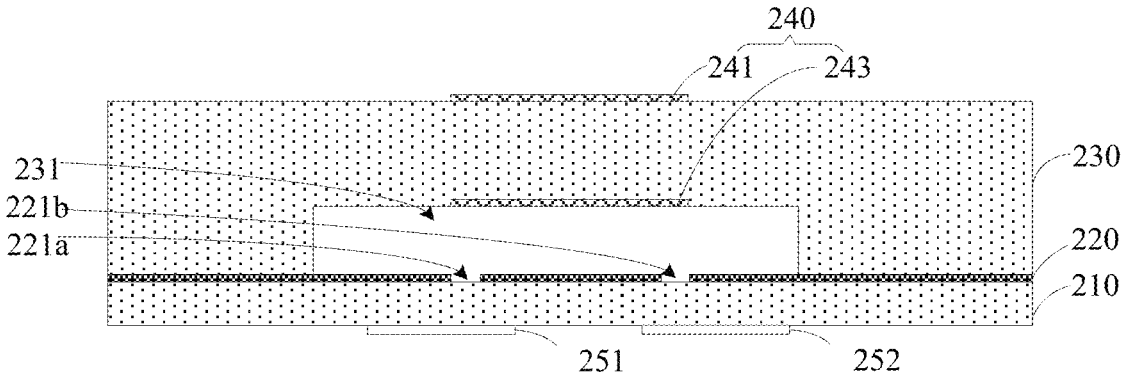
FIG. 5 is a sectional view of an antenna module in another embodiment.

As illustrated in FIG. 4A, FIG. 4B and FIG. 5, in an embodiment, the number of the slots 221 may be two, the slot 221 includes the first slot 221*a* and the second slot 221*b*, and the first slot 221*a* and the second slot 221*b* are arranged orthogonally. Moreover, the feeding unit 250 includes a first feeding route 251 and a second feeding route 252. The first feeding route 251 feeds the stacked patch antenna 240 through the first slot 221*a*, and the second feeding route 252 feeds the stacked patch antenna 240 through the second slot 221*b*. In some embodiments, the first slot 221*a* and the second slot 221*b* are arranged orthogonally. That is, the first slot 221*a* and the second slot 221*b* which are horizontally and vertically orthogonal are introduced into the ground layer 220. Furthermore, geometric centers of the first radiation patch 241 and the second radiation patch 243 are both located in an axis perpendicular to the first dielectric layer 210. That is, the first radiation patch 241 and the second radiation patch 243 are symmetrically arranged.

Figure 6A:
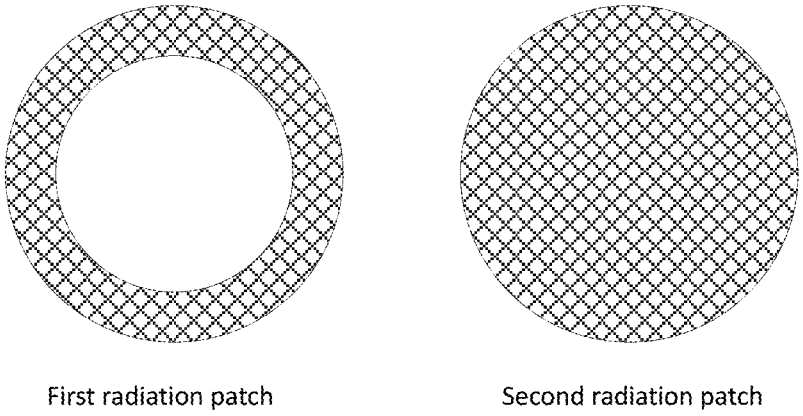
FIG. 6A is a schematic view of a first radiation patch and a second radiation patch in an embodiment.
Figure 6B:
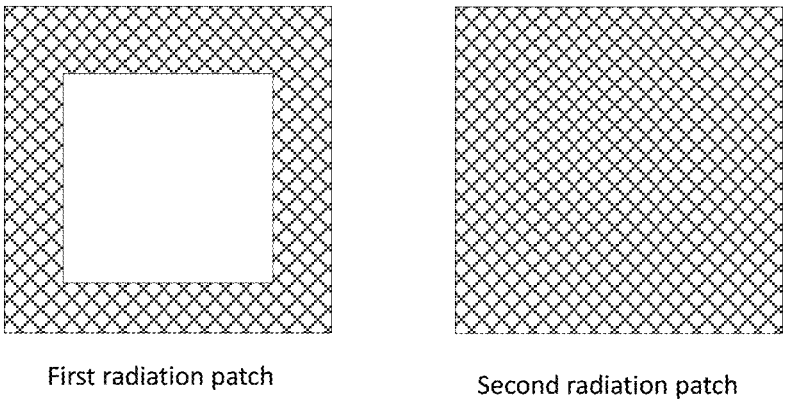
FIG. 6B is a schematic view of a first radiation patch and a second radiation patch in another embodiment.

In an embodiment, when the first radiation patch 241 is a loop patch antenna, an outline of the first radiation patch 241 is the same with an outline of the second radiation patch 243. For example, as illustrated in FIG. 6A, the first radiation patch 241 is a round loop patch, and the second radiation patch 243 is a round patch; or, as illustrated in FIG. 6B, the first radiation patch 241 is a square loop patch, and the second radiation patch 243 is a square patch, and so on. In this embodiment, by providing the first slot 221*a* and the second slot 221*b* arranged orthogonally, and by respective couplings of the first feeding route 251 and the second feeding route 252 at the bottom layer through the corresponding slot 221, the stacked patch antenna 240 (the first radiation patch 241 and the second radiation patch 243) is fed, such that the first radiation patch 241 generates the resonance in the 28 GHz frequency band, and the second radiation patch 243 generates the resonance in the 39 GHz frequency band. Further, the sizes of the first slot 221*a* and the second slot 221*b* are adjusted to couple with the stacked patch antenna 240 (the first radiation patch 241 and the second radiation patch 243), so as to generate another resonance in the vicinity of a 25 GHz frequency band, and thus the antenna can achieve the requirements of 3GPP full frequency band and dual polarization.

Figure 7:
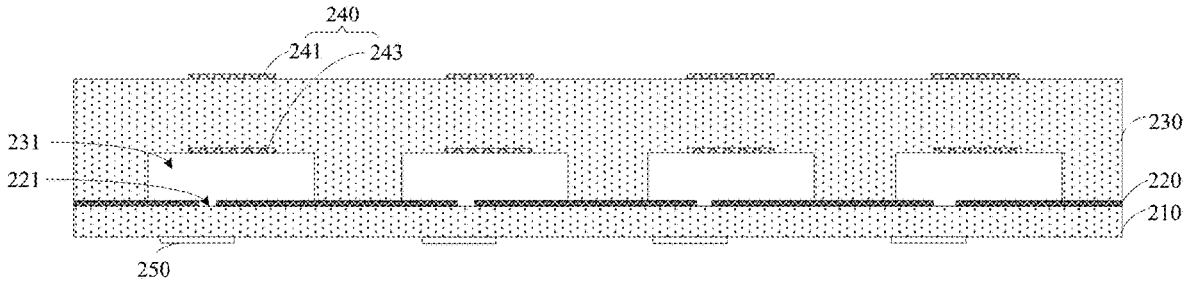
FIG. 7 is a sectional view of an antenna module in another embodiment.

As illustrated in FIG. 7, in an embodiment, the number of the first radiation patches 241, the number of the second radiation patches 243 and the number of the air chambers 231 are equal. When a plurality of the first radiation patches 241, the second radiation patches 243 and the air chambers 231 are provided, the first radiation patches 241 and the second radiation patches 243 are arranged in one to one correspondence. The second radiation patch 243 is attached to the side of the second dielectric layer 230 provided with the air chamber 231. Moreover, the number of the slots 221 provided in the ground layer 220 matches with the number of the first radiation patches 241. For example, the number of the slots 221 may be equal to the number of the first radiation patches 241, or the number of the slots 221 may be twice of the number of the first radiation patches 241, so as to meet the requirement of dual polarization.

For example, the number of the first radiation patches 241, the number of the second radiation patches 243, and the number of the air chambers 231 may all be set to four. That is, four first radiation patches 241 may form a first antenna array, and four second radiation patches 243 may form a second antenna array. In some embodiments, both the first antenna array and the second antenna array are one-dimensional linear arrays. For example, the first antenna array is a 1*4 linear array, and the second antenna array is also a 1*4 linear array.

In this embodiment, both the first antenna array and the second antenna array are one-dimensional linear arrays, so as to reduce an occupied space of the antenna module. Further, only one angle needs to be scanned, thereby simplifying a design difficulty, a test difficulty and a complexity of a wave beam management.

In an embodiment, the materials of the first dielectric layer 210 and the second dielectric layer 230 are low temperature co-fired ceramic (LTCC). A dielectric constant (DK) of LTCC is 5.9, and a loss factor (tan δ, Df, also known as a dielectric loss factor, a dielectric loss angle tangent) of LTCC is 0.002. A thickness of the second dielectric layer 230 between the first antenna array and the second antenna array is 0.5 mm, and a height of the chamber between the second antenna array and the ground layer 220 is 0.4 mm. The first antenna array includes four square loop patches. An outer edge length of the square loop patch is 1.3 mm, and an inner edge length of the square loop patch is 1.1 mm. The second antenna array includes four square patches with an edge length of 1.4 mm. The slot 221 provided in the ground layer 220 is a rectangular slot 221. A length of the rectangular slot 221 is 3 mm, and a width of the rectangular slot 221 is 0.16 mm.

Figure 8:
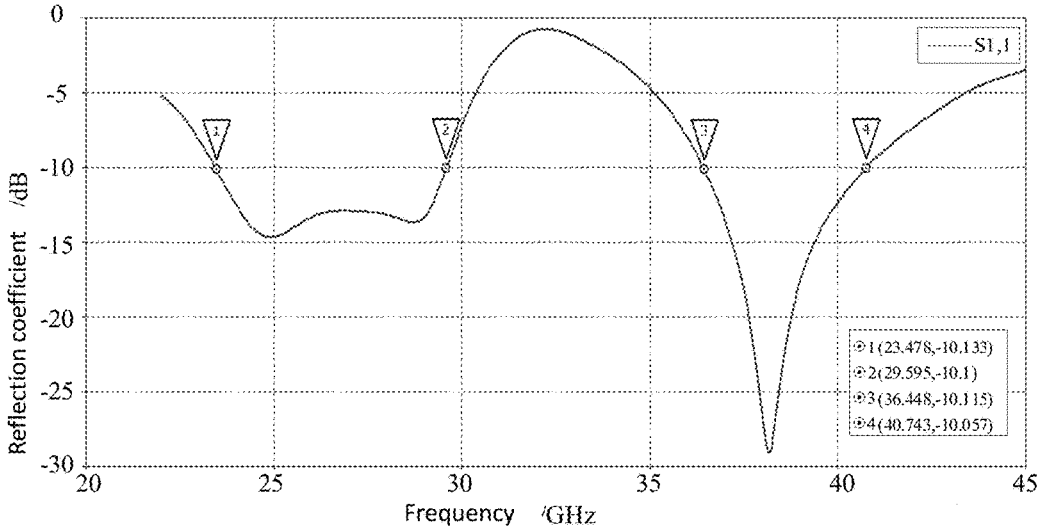
FIG. 8 is a diagram of a reflection coefficient of an antenna module in an embodiment.
Figure 9A:
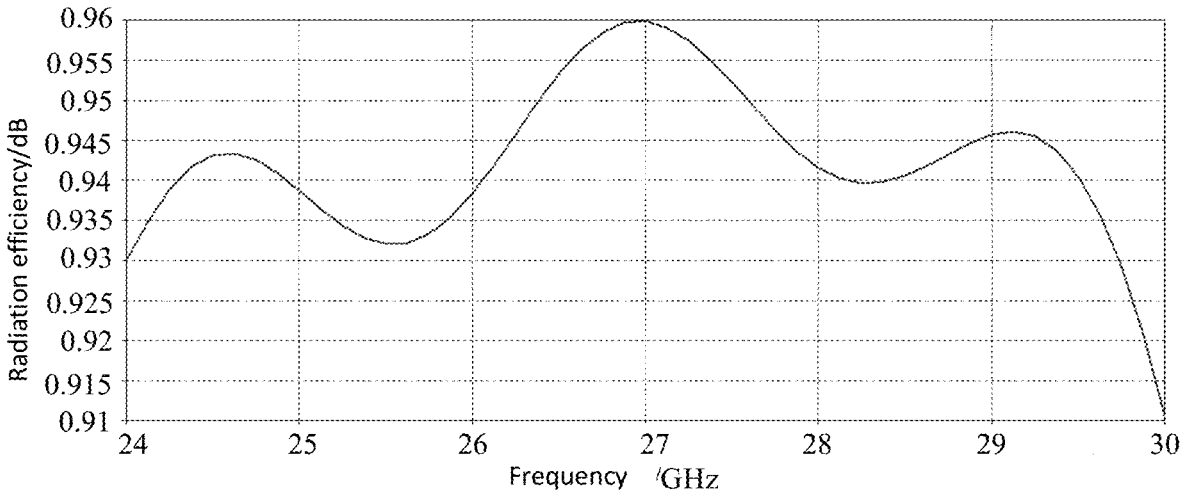
FIG. 9A is a diagram of an antenna efficiency of an antenna module in a 28 GHz frequency band in an embodiment.
Figure 9B:
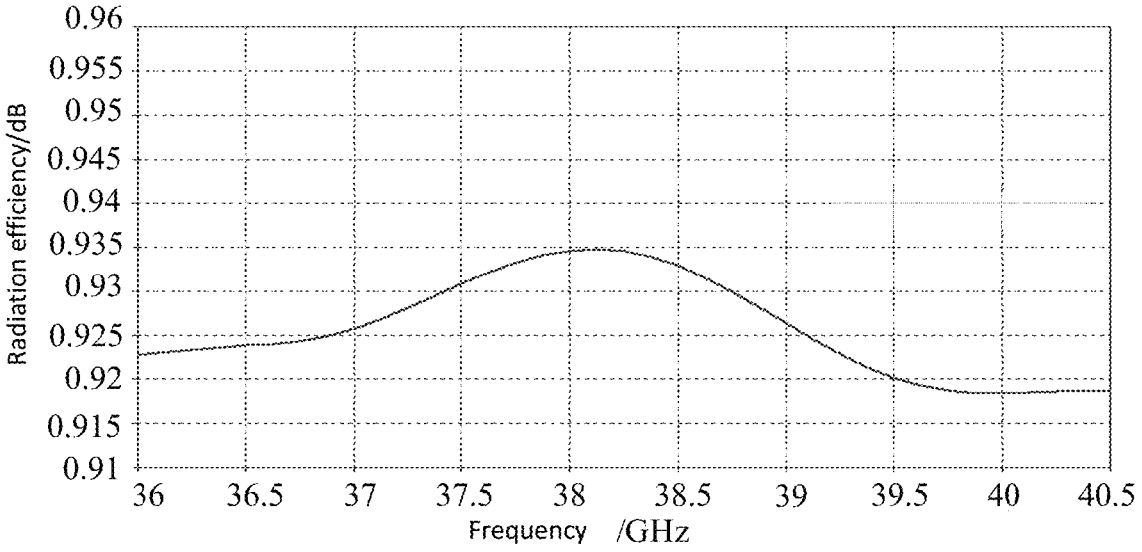
FIG. 9B is a diagram of an antenna efficiency of an antenna module in a 39 GHz frequency band in an embodiment.
Figure 10A:
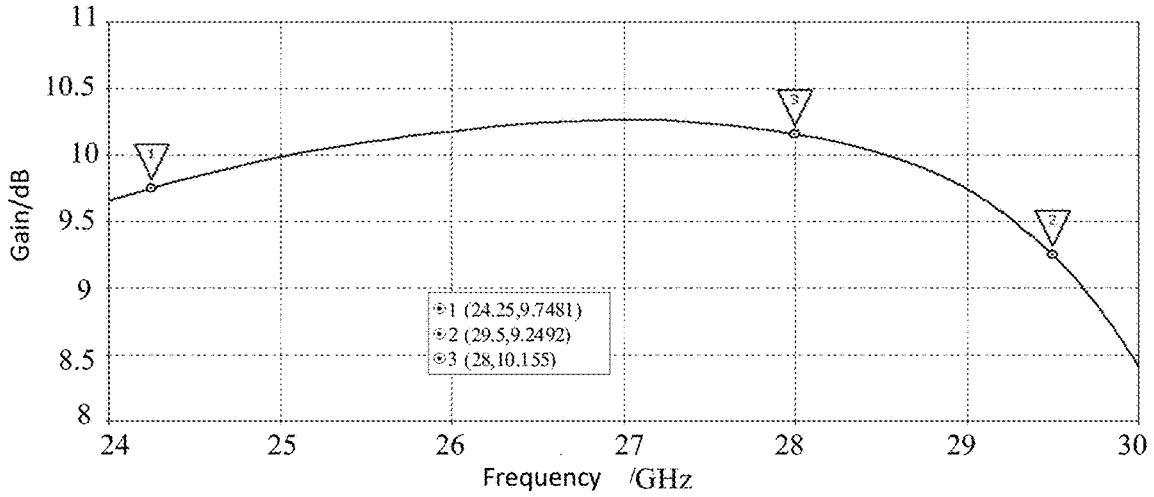
FIG. 10A is a diagram of an antenna gain of an antenna module with 0° phase shift in a 28 GHz frequency band in an embodiment.
Figure 10B:
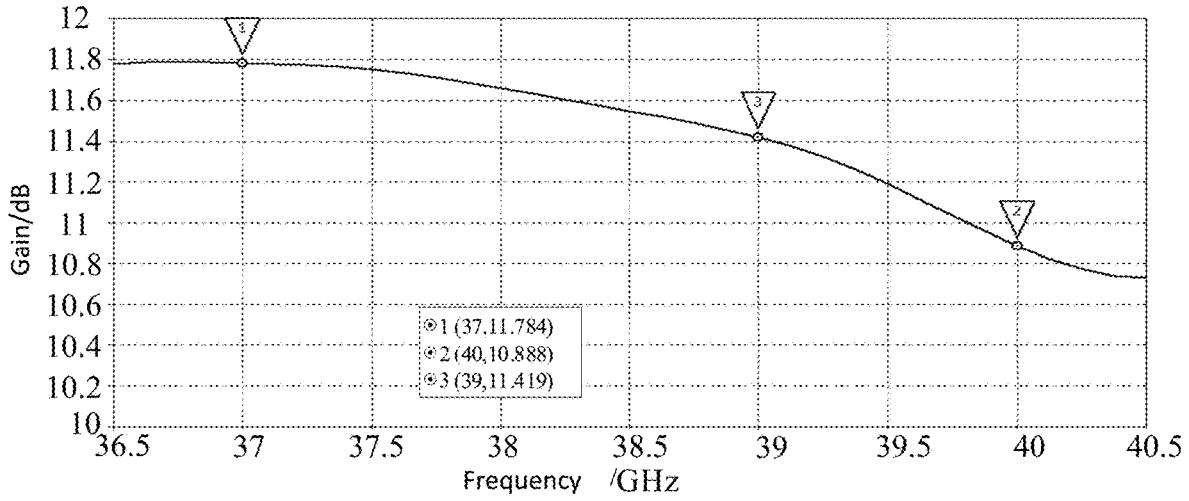
FIG. 10B is a diagram of an antenna gain of an antenna module with 0° phase shift in a 39 GHz frequency band in an embodiment.

FIG. 8 is a diagram of a reflection coefficient of the antenna module in an embodiment. As illustrated in FIG. 7, when an impedance bandwidth S11 is less than or equal to −10 dB, a working frequency band of the antenna module may cover the full frequency band (24.25-29.5 GHz, 37-40 GHz) of the millimeter wave specified by 3GPP. FIG. 9A is a diagram of an antenna efficiency of the antenna module in the 28 GHz frequency band in an embodiment, and FIG. 9B is a diagram of an antenna efficiency of the antenna module in the 39 GHz frequency band in an embodiment. As illustrated in FIG. 9A and FIG. 9B, the radiation efficiency of the antenna array in the full frequency band (24.25-29.5 GHz, 37-40 GHz) specified by 3GPP is more than 90%. FIG. 10A is a diagram of an antenna gain of the antenna module with 0° phase shift in the 28 GHz frequency band in an embodiment. FIG. 10B is a diagram of an antenna gain of the antenna module with 0° phase shift in the 39 GHz frequency band in an embodiment. As illustrated in FIG. 10A and FIG. 10B, the antenna gain keeps above 9.2 dB in the 28 GHz frequency band (24.25-29.5 GHz) and above 10.8 dB in the 39 GHz frequency band (37-40 GHz), thus satisfying the 3GPP performance index.

Figure 11A:
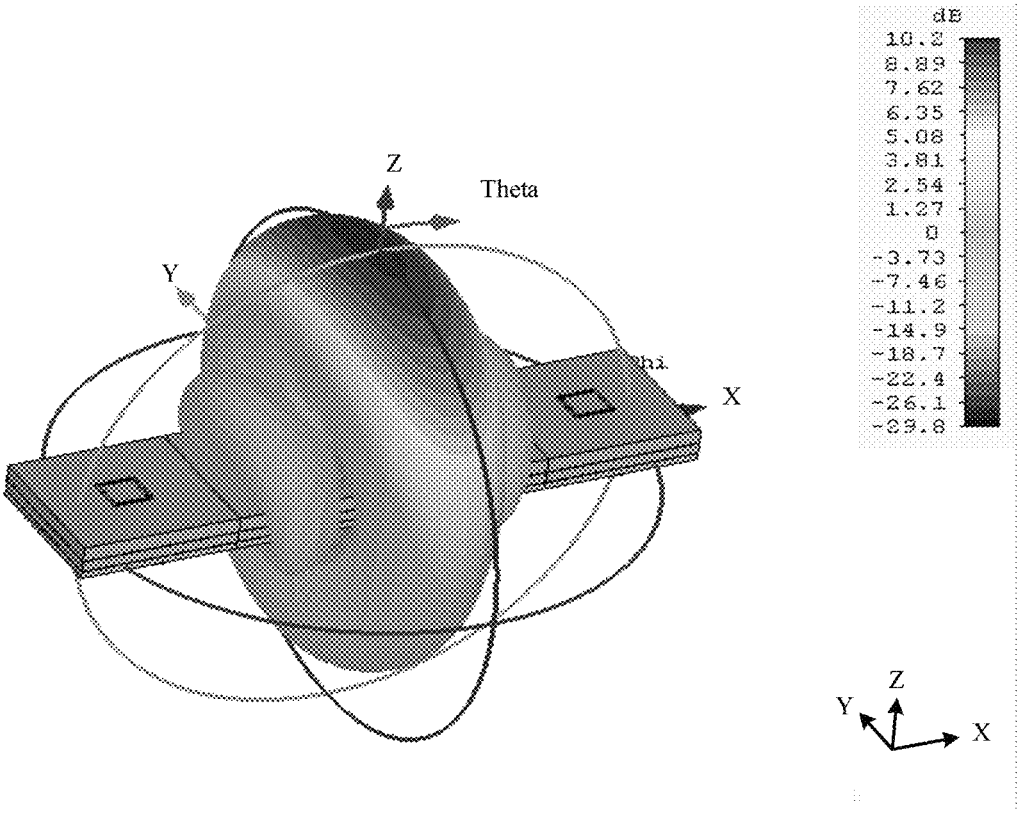
FIG. 11A is an antenna pattern at 28 GHz and in a 0° direction.
Figure 11B:
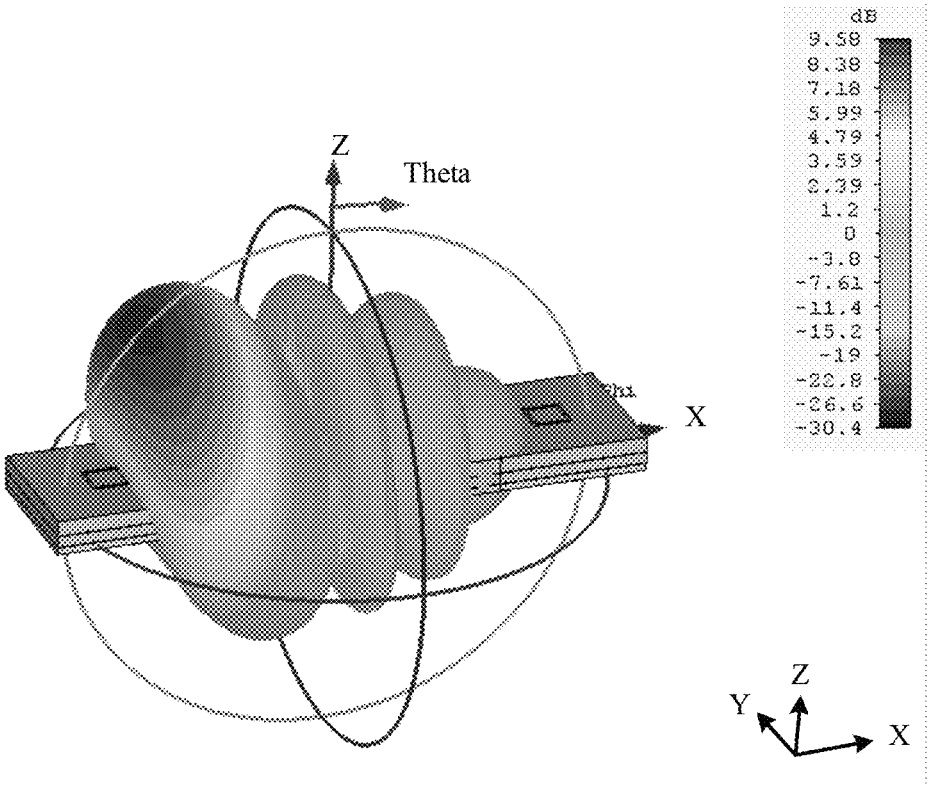
FIG. 11B is an antenna pattern at 28 GHz and in a 45° scanning direction.
Figure 11C:
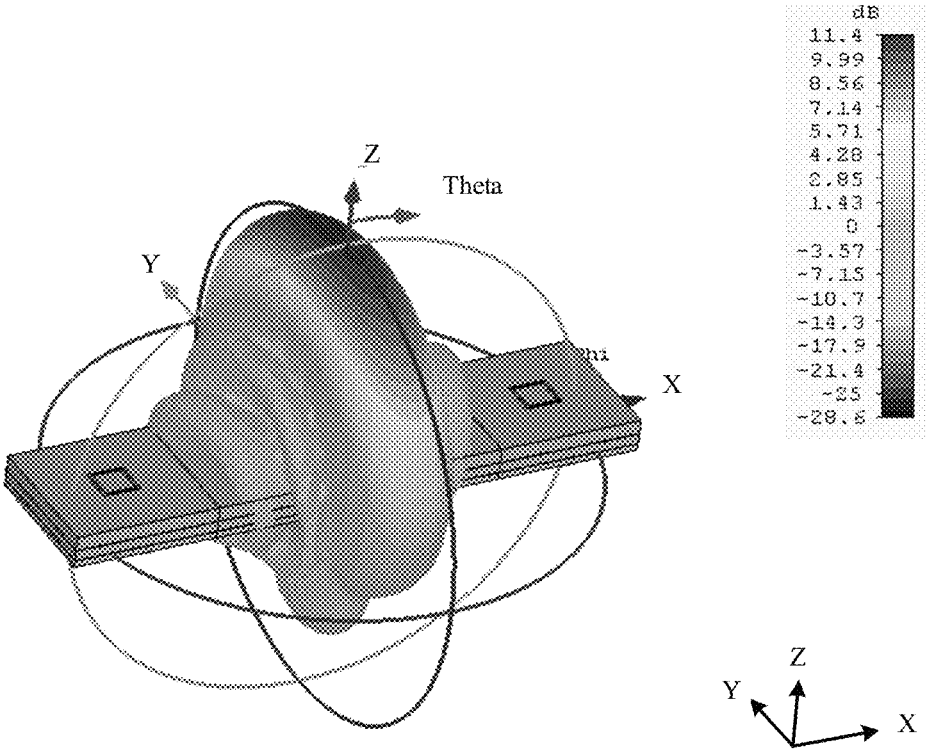
FIG. 11C is an antenna pattern at 39 GHz and in a 0° direction.

FIG. 11 is an antenna pattern of the antenna module in 28 GHz and 39 GHz frequency points in an embodiment. FIG. 11(*a*) illustrates an antenna pattern at 28 GHz and in a 0° direction, FIG. 11(*b*) illustrates an antenna pattern at 28 GHz and in a 45° scanning direction, and FIG. 11(*c*) illustrates an antenna pattern at 39 GHz and in the 0° direction. As can be seen from FIG. 11(*a*) and FIG. 11(*b*), the antenna module has a high gain and also a phase scanning function.

The antenna module in the embodiment adopts the LTCC technology to provide the air chamber 231 in the second dielectric layer 230, and to provide the slot 221 communicated with the air chamber 231 in the ground layer 220, and feeds the stacked patch antenna 240 by means of coupling through the slot 221, so as to introduce multiple resonance modes to realize a 3GPP full-frequency-band and high-efficiency antenna radiation. Moreover, the impedance bandwidth (S11≤−10 dB) of the antenna module covers a requirement of the millimeter wave full frequency band specified by 3GPP, and the antenna efficiency keeps above 90% within the millimeter wave full frequency band specified by 3GPP.

Figure 12:
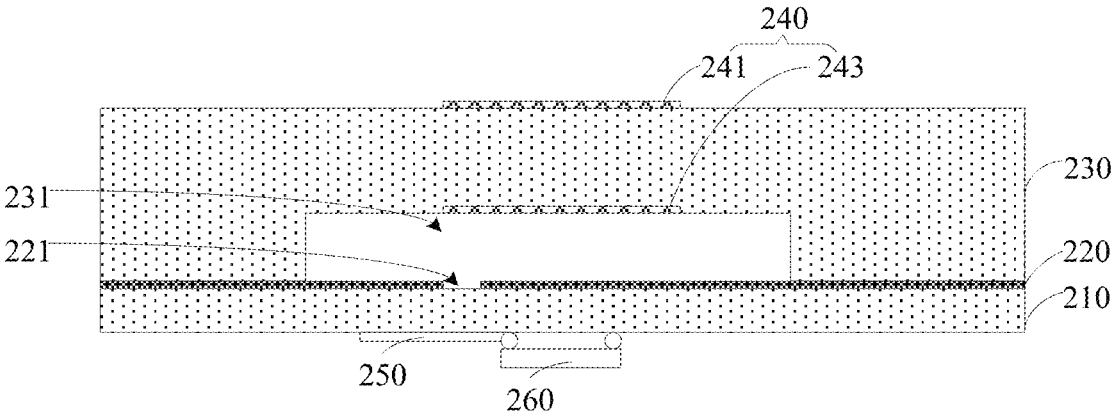
FIG. 12 is a sectional view of an antenna module in another embodiment.

As illustrated in FIG. 12, in an embodiment, the antenna module further includes a radio frequency integrated circuit 260, and the dual radio frequency integrated circuit 260 is encapsulated to the side of the first dielectric layer 210 facing away from the ground layer 220. A feeding port of the radio frequency integrated circuit 260 is connected with the feeding unit 250 so as to be interconnected with the stacked patch antenna 240.

The embodiment of the present disclosure also provides an antenna module, as illustrated in FIG. 5, and the antenna module includes a first dielectric layer 210, a ground layer 220, a second dielectric layer 230, a stacked patch antenna 240, and a feeding unit 250.

The ground layer 220 is arranged on the first dielectric layer 210, and provided with a first slot 221*a* and a second slot 221*b*. The second dielectric layer 230 is arranged on the ground layer 220, and provided with an air chamber 231 communicated with the first slot 221*a* and the second slot 221*b*, respectively.

The stacked patch antenna 240 includes a first radiation patch 241 and a second radiation patch 243 arranged corresponding to the first slot 221*a* and the second slot 221*b*. The first radiation patch 241 is attached to a side of the second dielectric layer 230 facing away from the ground layer 220, and the second radiation patch 243 is attached to a side of the second dielectric layer 230 provided with the air chamber 231. Geometric centers of the first radiation patch 241 and the second radiation patch 243 are both located in an axis perpendicular to the first dielectric layer 210.

In some embodiments, an orthogonal projection of the first radiation patch 241 on the ground layer 220 may cover at least part of the first slot 221*a* and/or at least part of the second slot 221*b*, and an orthogonal projection of the second radiation patch 243 on the ground layer 220 may cover at least part of the first slot 221*a* and/or at least part of the second slot 221*b*.

The feeding unit 250 is located to a side of the first dielectric layer 210 facing away from the ground layer 220. The feeding unit 250 feeds the stacked patch antenna 240 through the first slot 221*a* and the second slot 221*b*, such that the stacked patch antenna 240 generates a resonance in a first frequency band, a resonance in a second frequency band and a resonance in a third frequency band.

In an embodiment, the first slot 221*a* and the second slot 221*b* are arranged orthogonally. The feeding unit 250 includes a first feeding route 251 and a second feeding route 252. The first feeding route 251 feeds the stacked patch antenna 240 through the first slot 221*a*, and the second feeding route 252 feeds the stacked patch antenna 240 through the second slot 221*b*. In some embodiments, the first slot 221*a* and the second slot 221*b* are arranged orthogonally. That is, the first slot 221*a* and the second slot 221*b* which are horizontally and vertically orthogonal are introduced into the ground layer 220. Moreover, the geometric centers of the first radiation patch 241 and the second radiation patch 243 are both located in the axis perpendicular to the first dielectric layer 210. That is, the first radiation patch 241 and the second radiation patch 243 are symmetrically arranged.

In an embodiment, the first radiation patch 241 is completely orthogonally projected on an area where the second radiation patch 243 is located. Further, the first radiation patch 241 and the second radiation patch 243 are orthogonally projected on an area of the ground layer 220, at least partially overlapping the first slot 221*a*, or the first radiation patch 241 and the second radiation patch 243 are orthogonally projected on the area of the ground layer 220, at least partially overlapping the second slot 221*b*. In an embodiment, the first radiation patch 241 is orthogonally projected on the area of the ground layer 220, covering all or part of areas of the first slot 221*a* and the second slot 221*b*, and the second radiation patch 243 is orthogonally projected on the area of the ground layer 220, covering all or part of the areas of the first slot 221*a* and the second slot 221*b*.

In an embodiment, when the first radiation patch 241 is a loop patch antenna, an outline of the first radiation patch 241 is the same with an outline of the second radiation patch 243. For example, as illustrated in FIG. 6A, the first radiation patch 241 is a round loop patch, and the second radiation patch 243 is a round patch; or, as illustrated in FIG. 6B, the first radiation patch 241 is a square loop patch, and the second radiation patch 243 is a square patch, and so on. In this embodiment, by providing the first slot 221*a* and the second slot 221*b* arranged orthogonally, and by respective couplings of the first feeding route 251 and the second feeding route 252 at the bottom layer through the corresponding slot 221, the stacked patch antenna 240 (the first radiation patch 241 and the second radiation patch 243) is fed, such that the first radiation patch 241 generates the resonance in the 28 GHz frequency band, and the second radiation patch 243 generates the resonance in the 39 GHz frequency band. Further, the sizes of the first slot 221*a* and the second slot 221*b* are adjusted to couple with the stacked patch antenna 240 (the first radiation patch 241 and the second radiation patch 243), so as to generate another resonance in the vicinity of a 25 GHz frequency band, and thus the antenna can achieve the requirements of 3GPP full frequency band and dual polarization.

The embodiment of the present disclosure also provides an electronic device, which includes the antenna module in any one of the above embodiments. The electronic device having the antenna module according to any one of the above embodiments may be suitable for receiving and transmitting millimeter wave signals of 5G communication, thereby realizing the 3GPP full-frequency-band coverage, and further improving the radiation efficiency of the antenna.

The embodiment of the present disclosure also provides an electronic device, and the electronic device includes a housing, an antenna base plate 200, a stacked patch antenna 240, and a feeding unit 250. In some embodiments, the housing may be configured as the housing assembly 110 illustrated in FIG. 1.

The antenna base plate 200 is formed on the housing by means of a low temperature co-fired ceramic technology, and the antenna base plate 200 includes a first dielectric layer, a ground layer, and a second dielectric layer. The ground layer is arranged on the first dielectric layer, and provided with at least one slot. The second dielectric layer is arranged on the ground layer, and provided with an air chamber communicated with the slot.

The stacked patch antenna includes a first radiation patch and a second radiation patch arranged corresponding to the slot. The first radiation patch is attached to a side of the second dielectric layer facing away from the ground layer, and the second radiation patch is attached to a side of the second dielectric layer provided with the air chamber.

The feeding unit is located to a side of the first dielectric layer facing away from the ground layer. The feeding unit feeds the stacked patch antenna through the at least one slot, such that the first radiation patch generates a resonance in a first frequency band, and the second radiation patch generates a resonance in a second frequency band.

The sizes of various slots in the ground layer are adjusted to couple with the stacked patch antenna (the first radiation patch and the second radiation patch) so as to generate a resonance in the vicinity of a certain frequency band. Moreover, due to the arrangement of the air chamber, the coupling with the stacked patch antenna may be realized through the slot to generate a resonance in a preset frequency band, such that the first radiation patch generates the resonance in the first frequency band and the second radiation patch generates the resonance in the second frequency band, so as to realize the full frequency coverage of the antenna module.

In an embodiment, for example, the size (such as a length and a width) of the slot may be changed. When the length of the slot is set to ½ of a dielectric wavelength, the coupling between the slot and the stacked patch antenna 240 (the first radiation patch and the second radiation patch) can generate a resonance in the vicinity of a frequency band of 25 GHz-26 GHz. Moreover, based on the air chamber, the slot can conduct a coupled feeding with the first radiation patch to allow the first radiation patch to generate a resonance of 28 GHz, and can conduct a coupled feeding with the second radiation patch to allow the second radiation patch to generate a resonance of 39 GHz, so as to realize the full frequency coverage of the antenna module.

According to rules of 3GPP 38. 101 Agreement, 5G NR mainly uses two frequency bands: FR1 frequency band and FR2 frequency band. The frequency range of FR1 frequency band is 450 MHz-6 GHz, which is usually called sub 6 GHz. The frequency range of FR2 frequency band is 4.25 GHz-52.6 GHz, which is usually called millimeter wave (mm Wave). The 3GPP specifies frequency bands of the 5G millimeter wave as follows: n257 (26.5-29.5 GHz), n258 (24.25-27.5 GHz), n261 (27.5-28.35 GHz) and n260 (37-40 GHz).

The above antenna module adopts the LTCC technology to introduce the antenna base plate 200 in the housing, and introduces the air chamber and the slot communicated with the air chamber in the antenna base plate 200. Due to the introduction of the air chamber, the stacked patch antenna (the first radiation patch and the second radiation patch) may be fed by means of coupling through the slot, such that the first radiation patch generates the resonance in the first frequency band and the second radiation patch generates the resonance in the second frequency band. Thus, the full frequency coverage of the antenna module is achieved. That is, the 3GPP full frequency requirement is realized. For example, the coverage of n257, n258 and n261 bands may be realized, and also, the radiation efficiency of the antenna may be improved.

The electronic device may include a mobile phone, a tablet computer, a notebook computer, a palmtop computer, a mobile internet device (MID), a wearable device (such as a smart watch, a smart bracelet, a pedometer, and so on) or other communication modules provided with an antenna.

Figure 13:
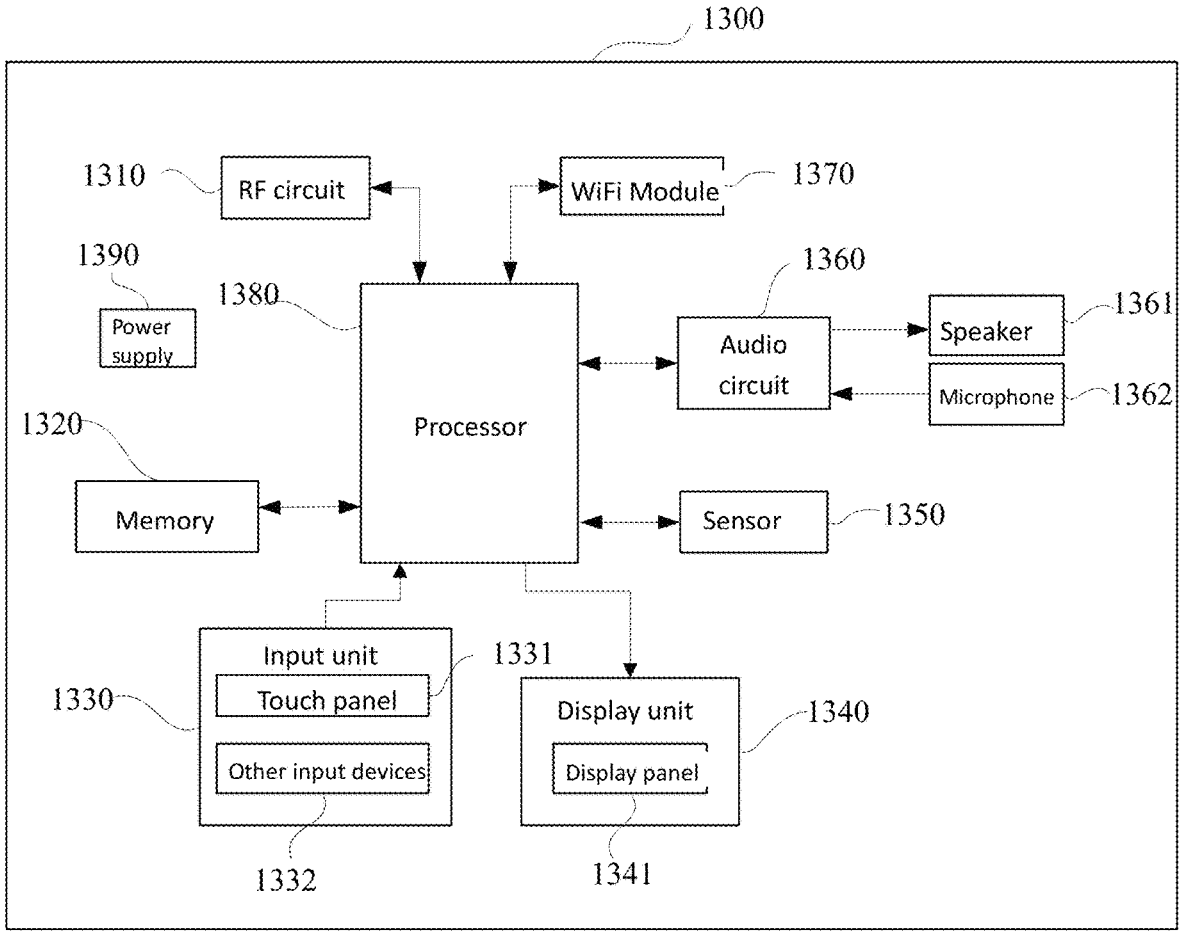
FIG. 13 is a block diagram of a partial structure of an electronic device provided by an embodiment of the present disclosure.

FIG. 13 is a block diagram of a partial structure of a mobile phone related to an electronic device provided by an embodiment of the present disclosure. As illustrated in FIG. 13, the mobile phone 1300 includes: an array antenna 1310, a memory 1320, an input unit 1330, a display unit 1340, a sensor 1350, an audio circuit 1360, a wireless fidelity (WIFI) module 1370, a processor 1380, a power supply 1390 and other components. It should be understood by those skilled in related art that the structure of the mobile phone illustrated in FIG. 13 is not construed to limit the mobile phone, and may include more or less components than the components illustrated, or combine some components, or have different component arrangements.

The array antenna 1310 may be used for receiving and transmitting signals in the process of receiving and transmitting information or calling. After receiving a downlink information of a base station, the array antenna 1310 may transmit the information to the processor 1380, or, the array antenna 1310 may transmit an uplink data to the base station. The memory 1320 may be used to store software programs and modules, and the processor 1380 may perform various function applications and data processing of the mobile phone by running the software programs and modules stored in the memory 1320. The memory 1320 may mainly include a program memory area and a data memory area. The program memory area may store an operating system, an application program required for at least one function (such as an application program for sound playing function, an application program for image playing function). The data memory area may store data (such as audio data, address book, and so on) created according to the use of the mobile phone, and so on. In addition, the memory 1320 may include a high-speed random access memory and also a non-volatile memory, such as at least one disk memory member, a flash memory member, or other volatile solid memory members.

The input unit 1330 may be used to receive input digital or character information, and generate a key signal input related to the user setting and the function control of the mobile phone 1300. In an embodiment, the input unit 1330 may include a touch panel 1331 and other input devices 1332. The touch panel 1331 also known as a touch screen, may collect user's touch operations on or near it (such as user's operations on or near the touch panel 1331 with any suitable object or accessory such as a finger, a touch pen), and drive a corresponding connection device according to a preset program. In an embodiment, the touch panel 1331 may include two parts: a touch measuring device and a touch controller. The touch measuring device measures a touch orientation of the user, measures a signal brought by the touch operation, and transmits the signal to the touch controller. The touch controller receives touch information from the touch measuring device, converts it into a contact coordinate, then sends it to the processor 1380, and receives and executes a command sent by the processor 1380. In addition, various kinds of touch panels 1331 may be realized, such as a resistance touch panel, a capacitance touch panel, an infrared touch panel and a surface-acoustic-wave touch panel. Besides the touch panel 1331, the input unit 1330 may further include other input devices 1332. In an embodiment, the other input devices 1332 may include, but are not limited to, one or more of a physical keyboard, and a function key (such as a volume control key, a switch key, and so on).

The display unit 1340 may be used to display information that is input by the user or provided to the user and various menus of the mobile phone. The display unit 1340 may include a display panel 1341. In an embodiment, the display panel 1341 may be configured in a form of a liquid crystal display (LCD), an organic light-emitting diode (OLED), and so on. In an embodiment, the touch panel 1331 may cover the display panel 1341. When the touch panel 1331 measures a touch operation on or near it, the touch operation is transmitted to the processor 1380 to determine a type of the touch operation. Then, the processor 1380 provides a corresponding visual output on the display panel 1341 according to the type of touch operation. Although in FIG. 13, the touch panel 1331 and the display panel 1341 serve as two independent components to realize the input and output functions of the mobile phone, the touch panel 1331 and the display panel 1341 may be integrated to realize the input and output functions of the mobile phone in some embodiments.

The mobile phone 1300 may further include at least one sensor 1350, such as an optical sensor, a motion sensor, and other sensors. In an embodiment, the light sensor may include an ambient light sensor and a proximity sensor. The ambient light sensor may adjust a brightness of the display panel 1341 according to the light and shade of an ambient light, and the proximity sensor may turn off the display panel 1341 and/or the backlight when the mobile phone moves to an ear. The motion sensor may include an acceleration sensor, which may measure accelerations in all directions. When the motion sensor stays still, it may measure a magnitude and a direction of gravity, which may be used to applications identifying a mobile phone posture (such as a horizontal and vertical screen switching), and functions related to vibration identification (such as a pedometer, a percussion), and so on. In addition, the mobile phone may be provided with a gyroscope, a barometer, a hygrometer, a thermometer, an infrared sensor and other sensors.

An audio circuit 1360, a speaker 1361 and a microphone 1362 may provide an audio interface between the user and the mobile phone. The audio circuit 1360 may transmit an electrical signal converted by the received audio data to the speaker 1361, and the speaker 1361 converts the electrical signal to a sound signal to be output. On the other hand, the microphone 1362 converts a collected audio signal into an electrical signal, the audio circuit 1360 receives the electrical signal and converts the electrical signal into audio data, and the audio data is output to the processor 1380 to be processed. Then, the processed audio date is sent to another mobile phone by the array antenna 1310, or output to the memory 1320 for subsequent processing.

The processor 1380 is a control center of the mobile phone, which uses various interfaces and lines to connect all parts of the mobile phone, and performs various functions of the mobile phone and processes data by running or executing software programs and/or modules stored in the memory 1320 and invoking data stored in the memory 1320, so as to monitor the overall mobile phone. In an embodiment, the processor 1380 may include one or more processing units. In an embodiment, the processor 1380 may integrate an application processor and a modulating-demodulating processor. The application processor mainly processes an operating system, a user interface, an application program, and so on. The modulating-demodulating processor mainly processes a wireless communication. It should be understood that the above modulating-demodulating processor may not be integrated into the processor 1380.

The mobile phone 1300 further includes a power supply 1390 (such as a battery) for supplying power to each component. In some embodiments, the power supply may be logically connected to the processor 1380 through a power management system, so as to realize functions of charging, discharging, and power consumption management through the power management system.

In an embodiment, the mobile phone 1300 may further include a camera, a bluetooth module, and so on.

Any reference to a memory, a storage, a database or other media used in the present disclosure may include a non-volatile and/or volatile memory. A suitable non-volatile memory may include a read-only memory (ROM), a programmable ROM (PROM), an electrically programmable ROM (EPROM), an electrically erasable programmable ROM (EEPROM), or a flash memory. The volatile memory may include a random access memory (RAM), which is used as an external cache memory. The RAM may be obtained in many forms, such as static random access memory (SRAM), a dynamic random access memory (DRAM), a synchronous dynamic random access memory (SDRAM), a double data rate synchronous dynamic random access memory (DDR SDRAM), an enhanced synchronous dynamic random access memory (ESDRAM), a synchlink dynamic random access memory (SLDRAM), a rambus direct random access memory (RDRAM), a direct rambus dynamic random access memory (DRDRAM), and a rambus dynamic random access memory (RDRAM).

Respective technical features of the above embodiments may be combined arbitrarily. In order to make the description concise, all possible combinations of the respective technical features in the above embodiments are not described. However, as long as the combinations of these technical features do not have contradictions, they should be considered to be fallen into the scope of the description.

The above embodiments only express several embodiments of the present disclosure, and the descriptions thereof are specific and detailed, which thus cannot be construed as a limitation of the protection scope of the present disclosure. It should be noted that for those skilled in the related art, several modifications and improvements can be made without departing from the principle of the present disclosure, which belong to the protection scope of the present disclosure. Therefore, the protection scope of the patent disclosure shall be subject to the appended claims.

What is claimed is:

1. An antenna module, comprising:

a first dielectric layer;

a ground layer arranged on the first dielectric layer, and provided with at least one slot;

a second dielectric layer arranged on the ground layer, and provided with an air chamber communicated with the at least one slot, wherein the air chamber is formed in a side of the second dielectric layer adjacent to the ground layer, and rest of the side of the second dielectric layer adjacent to the ground layer is in contact with the ground layer;

a stacked patch antenna comprising a first radiation patch and a second radiation patch, the first radiation patch being attached to a side of the second dielectric layer which facing away from the ground layer, the second radiation patch being attached to a side of the second dielectric layer provided with the air chamber, an orthogonal projection of the first radiation patch on the ground layer covering at least part of the at least one slot, and an orthogonal projection of the second radiation patch on the ground layer covering at least part of the at least one slot; and a feeding unit arranged to a side of the first dielectric layer facing away from the ground layer, and configured to feed the stacked patch antenna through the at least one slot, the first radiation patch being configured to generate a resonance in a first frequency band under the feeding of the feeding unit, and the second radiation patch being configured to generate a resonance in a second frequency band under the feeding of the feeding unit.

2. The antenna module according to claim 1, wherein the stacked patch antenna is configured to generate a resonance in a third frequency band by adjusting a size of the at least one slot.

3. The antenna module according to claim 1, wherein the at least one slot is a rectangular slot, and a routing direction of the feeding unit is arranged perpendicularly to a length direction of the rectangular slot.

4. The antenna module according to claim 1, wherein the at least one slot comprises a first part, a second part and a third part, the second part and the third part are communicated with the first part, respectively, the second part and the third part are arranged in parallel, and the first part is arranged perpendicularly to the second part and the third part, respectively, all the first part, the second part and the third part are linear slots, and a routing direction of the feeding unit is arranged perpendicularly to the first part of the at least one slot.

5. The antenna module according to claim 3, wherein the at least one slot comprises a first slot and a second slot, the first slot and the second slot are arranged orthogonally, and geometric centers of the first radiation patch and the second radiation patch are both located in an axis perpendicular to the first dielectric layer.

6. The antenna module according to claim 5, wherein the feeding unit comprises a first feeding route and a second feeding route, the first feeding route conducts a coupled feeding on the stacked patch antenna through the first slot, and the second feeding route conducts a coupled feeding on the stacked patch antenna through the second slot.

7. The antenna module according to claim 4, wherein the at least one slot comprises a first slot and a second slot, the first slot and the second slot are arranged orthogonally, and geometric centers of the first radiation patch and the second radiation patch are both located in an axis perpendicular to the first dielectric layer.

8. The antenna module according to claim 7, wherein the feeding unit comprises a first feeding route and a second feeding route, the first feeding route conducts a coupled feeding on the stacked patch antenna through the first slot, and the second feeding route conducts a coupled feeding on the stacked patch antenna through the second slot.

9. The antenna module according to claim 1, wherein the numbers of the first radiation patches, the second radiation patches and the air chambers are equal, when a plurality of the first radiation patches, the second radiation patches and the air chambers are provided, the first radiation patches and the second radiation patches are arranged in one to one correspondence.

10. The antenna module according to claim 1, wherein a depth range of the air chamber is 0.2 mm-0.5 mm in a direction perpendicular to the stacked patch antenna.

11. The antenna module according to claim 1, wherein the first radiation patch is a loop patch antenna, and the second radiation patch is one of a square patch, a round patch, a loop patch and a cross patch.

12. The antenna module according to claim 11, wherein an outline of the first radiation patch is the same with an outline of the second radiation patch.

13. The antenna module according to claim 1, wherein the air chamber is formed by means of low temperature co-fired ceramic technology.

14. The antenna module according to claim 1, further comprising a radio frequency integrated circuit encapsulated to the side of the first dielectric layer facing away from the ground layer, a feeding port of the radio frequency integrated circuit being connected with the feeding unit to interconnect with the stacked patch antenna.

15. The antenna module according to claim 1, wherein the first frequency band comprises a 28 GHz frequency band of 5G millimeter wave, and the second frequency band comprises a 39 GHz frequency band of 5G millimeter wave.

16. The antenna module according to claim 2, wherein the third frequency band comprises a 25 GHz frequency band of 5G millimeter wave.

17. An antenna module, comprising:

a first dielectric layer;

a ground layer arranged on the first dielectric layer, and having a first slot and a second slot therein;

a second dielectric layer arranged on the ground layer, and defining an air chamber in a side adjacent to the ground layer, the air chamber being communicated with the first slot and the second slot, respectively, wherein rest of the side of the second dielectric layer adjacent to the ground layer is in contact with the ground layer;

a stacked patch antenna comprising a first radiation patch and a second radiation patch, the first radiation patch being attached to a side of the second dielectric layer facing away from the ground layer, the second radiation patch being received in the air chamber and attached to a bottom of the air chamber facing the ground layer, an orthogonal projection of the first radiation patch on the ground layer covering at least one of at least part of the first slot and at least part of the second slot, and an orthogonal projection of the second radiation patch on the ground layer covering at least one of at least part of the first slot and at least part of the second slot; and a feeding unit arranged to a side of the first dielectric layer facing away from the ground layer, and configured to feed the first radiation patch through the first slot and feed the second radiation patch through the second slot.

18. An electronic device, comprising:

a housing;

an antenna base plate arranged to the housing, and comprising:

a first dielectric layer;

a ground layer arranged on the first dielectric layer, and having at least one slot therein; and a second dielectric layer arranged on the ground layer, and defining an air chamber therein, the air chamber being communicated with the at least one slot, wherein the air chamber is formed in a side of the second dielectric layer adjacent to the ground layer, and rest of the side of the second dielectric layer adjacent to the ground layer is in contact with the ground layer;

a stacked patch antenna comprising a first radiation patch and a second radiation patch, the first radiation patch being attached to a side of the second dielectric layer facing away from the ground layer, the second radiation patch being attached to a side of the second dielectric layer provided with the air chamber, an orthogonal projection of the first radiation patch on the ground layer covering at least part of the at least one slot, and an orthogonal projection of the second radiation patch on the ground layer covering at least part of the at least one slot; and a feeding unit arranged to a side of the first dielectric layer facing away from the ground layer, the feeding unit being configured to feed the stacked patch antenna through the at least one slot, the first radiation patch being configured to generate a resonance in a first frequency band under the feeding of the feeding unit, and the second radiation patch being configured to generate a resonance in a second frequency band under the feeding of the feeding unit.

19. The electronic device according to claim 18, wherein the stacked patch antenna is configured to generate a resonance in a third frequency band by adjusting a size of the at least one slot.

20. The electronic device according to claim 19, wherein the first frequency band comprises a 28 GHz frequency band of 5G millimeter wave, the second frequency band comprises a 39 GHz frequency band of 5G millimeter wave, and the third frequency band comprises a 25 GHz frequency band of 5G millimeter wave.

* * * * *